US009399807B2

(12) United States Patent
Crook et al.

(10) Patent No.: US 9,399,807 B2
(45) **Date of Patent: *Jul. 26, 2016**

(54) ACID AND ALKALI RESISTANT NI—CR—MO—CU ALLOYS WITH CRITICAL CONTENTS OF CHROMIUM AND COPPER

(71) Applicants: Paul Crook, Kokomo, IN (US); Vinay Deodeshmukh, Carmel, IN (US)

(72) Inventors: Paul Crook, Kokomo, IN (US); Vinay Deodeshmukh, Carmel, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/055,126

(22) Filed: Oct. 16, 2013

(65) Prior Publication Data

US 2014/0044587 A1 Feb. 13, 2014

Related U.S. Application Data

(63) Continuation-in-part of application No. 13/871,405, filed on Apr. 26, 2013, which is a continuation-in-part of application No. 13/719,369, filed on Dec. 19, 2012.

(60) Provisional application No. 61/640,096, filed on Apr. 30, 2012.

(51) Int. Cl.
*C22C 19/05* (2006.01)
*C22F 1/10* (2006.01)

(52) U.S. Cl.
CPC ..... *C22C 19/055* (2013.01); *C22C 19/053* (2013.01); *C22F 1/10* (2013.01)

(58) Field of Classification Search
CPC .... C22C 19/05; C22C 19/055; C22C 19/053; C22C 30/00
See application file for complete search history.

(56) References Cited

U.S. PATENT DOCUMENTS

| | | | | |
|---|---|---|---|---|
| 3,844,774 | A | 10/1974 | Culling | |
| 4,836,985 | A | 6/1989 | Culling | |
| 5,529,642 | A * | 6/1996 | Sugahara et al. | 148/427 |
| 6,280,540 | B1 | 8/2001 | Crook | |
| 6,623,869 | B1 | 9/2003 | Nishiyama et al. | |
| 6,740,291 | B2 | 5/2004 | Crook | |
| 6,764,646 | B2 | 7/2004 | Crook et al. | |
| 2008/0279716 | A1 | 11/2008 | Nishiyama et al. | |
| 2010/0034690 | A1 | 2/2010 | Nishiyama et al. | |
| 2011/0236252 | A1 | 9/2011 | Ueyama et al. | |
| 2012/0195790 | A1 | 8/2012 | Ueyama et al. | |

FOREIGN PATENT DOCUMENTS

| | | | |
|---|---|---|---|
| EP | 1717330 | A1 * | 11/2006 |
| EP | 2256220 | A1 | 12/2010 |
| WO | 2011034100 | A1 | 3/2011 |

OTHER PUBLICATIONS

ASM Handbook vol. 2 "Physical Metallurgy of Nickel and Nickel Alloys", 1990, pp. 1365-1370.*

Cunningham, Larry D. "Columbium (niobium)." Plunkert, PA, and Jones, TS, comps., Metal prices in the United States through (1998): 35-38.*

Cunningham, Larry D. "Columbium (Niobium) and Tantalum" (1991): pp. 467-500.*

European Search Report for EP 13 00 2282 dated Jul. 18, 2013.

* cited by examiner

*Primary Examiner* — Jessee Roe

(74) *Attorney, Agent, or Firm* — Buchanan Ingersoll & Rooney PC

(57) ABSTRACT

A nickel—chromium—molybdenum—copper alloy resistant to 70% sulfuric acid at 93° C. and 50% sodium hydroxide at 121° C. for acid and alkali neutralization in the field of waste management; the alloy contains, in weight percent, 27 to 33 chromium, 4.9 to 7.8 molybdenum, 3.1 to 6.0 wt. % copper (when chromium is between 30 and 33 wt. %) or 4.7 to 6.0 wt. % copper (when chromium is between 27 and 29.9 wt. %), up to 3.0 iron, 0.3 to 1.0 manganese, 0.1 to 0.5 aluminum, 0.1 to 0.8 silicon, 0.01 to 0.11 carbon, up to 0.13 nitrogen, up to 0.05 magnesium, up to 0.05 rare earth elements, with a balance of nickel and impurities. Titanium or another MC carbide former can be added to enhance thermal stability of the alloy.

11 Claims, No Drawings

ACID AND ALKALI RESISTANT NI—CR—MO—CU ALLOYS WITH CRITICAL CONTENTS OF CHROMIUM AND COPPER

CROSS REFERENCE TO RELATED APPLICATIONS

This application claims the benefit of provisional application Ser. No. 61/640,096 filed Apr. 30, 2012 and is a continuation-in-part of U.S. application Ser. No. 13/871,405, filed on Apr. 26, 2013, which is a continuation-in-part of U.S. application Ser. No. 13/719,369, filed on Dec. 19, 2012.

FIELD OF INVENTION

This invention relates generally to non-ferrous alloy compositions, and more specifically to nickel-chromium-molybdenum-copper alloys that provide a useful combination of resistance to 70% sulfuric acid at 93° C. and resistance to 50% sodium hydroxide at 121° C.

BACKGROUND

In the field of waste management, there is a need for metallic materials which resist hot, strong acids and hot, strong caustic alkalis. This is because such chemicals are used to neutralize one another, resulting in more stable and less hazardous compounds. Of the acids used in industry, sulfuric is the most important in terms of the quantities produced. Of the caustic alkalis, sodium hydroxide (caustic soda) is the most commonly used.

Certain nickel alloys are very resistant to strong, hot sulfuric acid. Others are very resistant to hot, strong sodium hydroxide. However, none possesses adequate resistance to both chemicals.

Typically, nickel alloys with high alloy contents are used to resist sulfuric acid and other strong acids, the most resistant being the nickel-molybdenum and nickel-chromium-molybdenum alloys.

On the other hand, pure nickel (UNS N02200/Alloy 200) or nickel alloys with low alloy contents are the most resistant to sodium hydroxide. Where higher strength is required, the nickel-copper and nickel-chromium alloys are used. In particular, alloys 400 (Ni—Cu, UNS N04400) and 600 (Ni—Cr, UNS N06600) possess good resistance to corrosion in sodium hydroxide.

During the discovery of the alloys of this invention, two key environments were used, namely 70 wt. % sulfuric acid at 93° C. (200° F.) and 50 wt. % sodium hydroxide at 121° C. (250° F.). 70 wt. % sulfuric acid is well known to be very corrosive to metallic materials, and is the concentration at which the resistance of many materials (including the nickel-copper alloys) breaks down, as a result of changes in the cathodic reaction (from reducing to oxidizing). 50 wt. % sodium hydroxide is the concentration most widely used in industry. A higher temperature was used in the case of sodium hydroxide to increase internal attack (the main form of degradation of nickel alloys in this chemical), hence increase the accuracy of measurements during subsequent cross-sectioning and metallographic examination.

In U.S. Pat. No. 6,764,646 Crook et al. describe nickel-chromium-molybdenum-copper alloys resistant to sulfuric acid and wet process phosphoric acid. These alloys require copper in the range 1.6 to 2.9 wt. %, which is below the levels required for resistance to 70% sulfuric acid at 93° C. and 50% sodium hydroxide at 121° C.

U.S. Pat. No. 6,280,540 to Crook discloses copper-containing, nickel-chromium-molybdenum alloys which have been commercialized as C-2000® alloy and correspond to UNS 06200. These contain higher molybdenum levels and lower chromium levels than in the alloys of this invention and lack the aforementioned corrosion characteristics.

U.S. Pat. No. 6,623,869 to Nishiyama et al. describes nickel-chromium-copper alloys for metal dusting service at high temperatures, the maximum copper contents of which are 3 wt. %. This is below the range required for resistance to 70% sulfuric acid at 93° C. and 50% sodium hydroxide at 121° C. More recent U.S. Patent Application Publications (US 2008/0279716 and US 2010/0034690) by Nishiyama et al. describe additional alloys for resistance to metal dusting and carburization. The alloys of US 2008/0279716 differ from the alloys of this invention in that they have a molybdenum restriction of not more than 3%. The alloys of US 2010/0034690 are in a different class, being iron-based, rather than nickel-based, with a molybdenum content of 2.5% or less. U.S. Published Patent Application No. US2011/0236252 to Ueyama et al. discloses nickel-chromium-molybdenum-copper alloys resistant to reducing hydrochloric and sulfuric acids. The given range in these alloys for chromium is 20 to 30% and for copper it is 2 to 5%; however, the inventive alloy examples given in this patent contain chromium up to 23% and copper up to 3.06%, which are below the levels needed for resistance to 70% sulfuric at 93° C. and 50% sodium hydroxide at 121° C.

SUMMARY OF THE INVENTION

The principal object of this invention is to provide alloys, capable of being processed into wrought products (sheets, plates, bars, etc.), which exhibit a useful and elusive combination of resistance to 70% sulfuric acid at 93° C. (200° F.) and resistance to 50% sodium hydroxide at 121° C. (250° F.). These highly desirable properties have been unexpectedly attained using a nickel base, chromium between 27 and 33 wt. %, molybdenum between 4.9 and 7.8 wt. %, and copper between 3.1 and 6.0 wt. %, with the proviso that if chromium is below 30 wt. %, then copper must be at least 4.7 wt. %. For chromium contents between 30 and 33 wt. %, the full range of copper (3.1 to 6.0 wt. %) provides these highly desirable properties.

To enable the removal of oxygen and sulfur during the melting process, such alloys typically contain small quantities of aluminum and manganese (up to about 0.5 and 1.0 wt. %, respectively in the nickel-chromium-molybdenum alloys), and possibly traces of magnesium and the rare earth elements (up to about 0.05 wt. %). In our experiments, aluminum contents of between 0.1 and 0.5 wt. %, and manganese contents between 0.3 and 1.0 wt. %, were found to result in successful alloys.

Iron is the most likely impurity in such alloys, due to contamination from other nickel alloys melted in the same furnaces, and maxima of 2.0 or 3.0 wt. % are typical of those nickel-chromium-molybdenum alloys that do not require an iron addition. In our experiments, iron contents up to 3.0 wt. % were found to be acceptable.

Other metallic impurities are possible in such alloys, due to furnace contamination and impurities in the charge materials. The alloys of this invention should be able to tolerate these impurities at the levels commonly encountered in the nickel-chromium-molybdenum alloys. Also, alloys of such high chromium content cannot be air melted without some pick up of nitrogen. It is usual, therefore, in high chromium nickel alloys to allow up to 0.13 wt. % maximum of this element.

With regard to carbon content, the successful alloys in our experiments contained between 0.01 and 0.11 wt. %. Surprisingly, Alloy G with a carbon content of 0.002 wt. % could not be processed into wrought products. Thus a carbon range of 0.01 to 0.11 wt. % is preferred.

With regard to silicon, a range of 0.1 to 0.8 wt. % is preferred, based on the fact that levels at each end of this range provided satisfactory properties.

The microstructural stabilities of these alloys at elevated temperatures can be improved by encouraging the formation of MC carbides, which are very stable.

DETAILED DESCRIPTION OF THE INVENTION

The discovery of the compositional range defined above involved study of a wide range of nickel-based compositions, of varying chromium, molybdenum, and copper contents. These compositions are presented in Table 1. For comparison, the compositions of the commercial alloys used to resist either 70% sulfuric acid or 50% sodium hydroxide are included in Table 1.

Those alloys which were successfully rolled to the required test thickness were subjected to annealing trials, to determine (by metallographic means) the most suitable annealing treatments. Fifteen minutes at temperatures between 1121° C. and 1149° C., followed by water quenching were determined to be appropriate, in all cases, The commercially produced alloys were all tested in the condition sold by the manufacturer, the so-called "mill annealed" condition.

Corrosion tests were performed on samples measuring 25.4×25.4×3.2 mm. Prior to corrosion testing, surfaces of all samples were manually ground using 120 grit papers, to negate any surface layers and defects that might affect corrosion resistance. The tests in sulfuric acid were carried out in glass flask/condenser systems. The tests in sodium hydroxide were carried out in TEFLON systems, since glass is attacked by sodium hydroxide. A time of 96 hours was used for the sulfuric acid tests, with interruptions every 24 hours to enable samples to be weighed, while a duration of 720 hours was used for the sodium hydroxide tests. Two samples of each alloy were tested in each environment, and the results averaged.

TABLE 1

Compositions of Experimental and Commercial Alloys

| Alloy | Ni | Cr | Mo | Cu | Fe | Mn | Al | Si | C | Other |
|---|---|---|---|---|---|---|---|---|---|---|
| A* | Bal. | 27 | 7.8 | 6.0 | 1.1 | 0.3 | 0.2 | 0.1 | 0.03 | |
| B* | Bal. | 27 | 7.5 | 5.9 | 1.1 | 0.3 | 0.3 | 0.1 | 0.01 | |
| C | Bal. | 28 | 7.3 | 3.1 | 1.1 | 0.3 | 0.3 | 0.1 | 0.01 | |
| D | Bal. | 30 | 8.2 | 2.6 | 0.9 | 0.3 | 0.5 | 0.1 | 0.03 | |
| E* | Bal. | 29 | 6.6 | 4.7 | 0.9 | 0.4 | 0.1 | 0.3 | 0.01 | |
| F* | Bal. | 30 | 6.6 | 4.8 | 3.0 | 1.0 | 0.5 | 0.8 | 0.11 | |
| G | Bal. | 29 | 6.6 | 4.8 | 0.04 | <0.01 | <0.01 | <0.01 | 0.002 | |
| H* | Bal. | 31 | 4.9 | 5.9 | 0.9 | 0.5 | 0.4 | 0.3 | 0.03 | |
| I* | Bal. | 31 | 5.2 | 4.5 | 1.2 | 0.4 | 0.4 | 0.3 | 0.04 | |
| J | Bal. | 31 | 5.7 | 2.7 | 1.1 | 0.4 | 0.2 | 0.3 | 0.03 | |
| K | Bal. | 31 | 5.0 | 10.0 | 1.0 | 0.4 | 0.4 | 0.3 | 0.03 | |
| L | Bal. | 30 | 5.6 | 8.2 | 1.0 | 0.5 | 0.2 | 0.5 | 0.03 | |
| M | Bal. | 31 | 8.9 | 2.5 | 1.0 | 0.5 | 0.2 | 0.4 | 0.03 | |
| N* | Bal. | 31 | 5.1 | 3.1 | 1.2 | 0.3 | 0.4 | 0.1 | 0.02 | |
| O* | Bal. | 33 | 5.6 | 4.5 | 1.0 | 0.4 | 0.2 | 0.3 | 0.03 | |
| P* | Bal. | 30 | 6.9 | 4.8 | <0.05 | 0.4 | 0.3 | 0.4 | 0.03 | |
| Q* | Bal. | 31 | 5.5 | 4.0 | 1.0 | 0.5 | 0.3 | 0.4 | 0.03 | |
| R* | Bal. | 30 | 5.4 | 4.0 | 1.0 | 0.5 | 0.3 | 0.4 | 0.07 | |
| S* | Bal. | 31 | 5.6 | 3.8 | 0.9 | 0.4 | 0.3 | 0.4 | 0.06 | |
| 200** | 99.0 min (Ni + Co) | — | — | 0.1 | 0.2 | 0.2 | — | 0.2 | 0.08 | |
| 400** | 66.5 Ni + Trace Co | — | — | 31.5 | 1.2 | 1.0 | — | 0.2 | 0.2 | |
| 600** | 76.0 | 15.5 | — | 0.2 | 8.0 | 0.5 | — | 0.2 | 0.08 | |
| C-4** | 65.0 | 16.0 | 16.0 | 0.5 max | 3.0 max | 1.0 max | — | 0.08 max | 0.01 max | Ti 0.7 max |
| C-22** | 56.0 | 22.0 | 13.0 | 0.5 max | 3.0 | 0.5 max | — | 0.08 max | 0.01 max | W 3.0 V 0.35 max |
| C-276** | 57.0 | 16.0 | 16.0 | 0.5 max | 5.0 | 1.0 max | — | 0.08 max | 0.01 max | W 4.0 V 0.35 max |
| C-2000** | 59.0 | 23.0 | 16.0 | 1.6 | 3.0 max | 0.5 max | 0.5 max | 0.08 max | 0.01 max | |
| G-30** | 43.0 | 30.0 | 5.5 | 2.0 | 15.0 | 1.5 max | — | 0.8 max | 0.03 max | Co 5.0 max Nb 0.8 W 2.5 max |
| G-35** | 58.0 | 33.2 | 8.1 | 0.3 max | 2.0 max | 0.5 max | 0.4 max | 0.6 max | 0.05 max | W 0.6 max |

*denotes an alloy of this invention,
**denotes a nominal composition

The experimental alloys were made by vacuum induction melting (VIM), then electro-slag re-melting (ESR), at a heat size of 13.6 kg. Traces of nickel-magnesium and/or rare earths were added to the VIM furnace charges, to help minimize the sulfur and oxygen contents of the experimental alloys. The ESR ingots were homogenized, hot forged, and hot rolled into sheets of thickness 3.2 mm for test. Surprisingly, three of the alloys (G, K, and L) cracked so badly during forging that they could not be hot rolled into sheets for testing.

In sulfuric acid, the primary mode of degradation is uniform attack, thus average corrosion rates were calculated from weight loss measurements. In sodium hydroxide, the primary mode of degradation is internal attack, which is either a uniform attack or more aggressive form of internal "dealloying" attack. Dealloying generally refers to the leaching of certain elements (for example, molybdenum) from the alloy, which often degrades the mechanical properties as well. The maximum internal attack can only be measured by sectioning the samples and studying them metallographically. The values presented in Table 2 represent measured maximum internal penetration in the alloy cross-section.

To differentiate between acceptable and unacceptable rates of attack, a pass/fail criterion of 0.45 mm/y (of uniform attack, in the case of sulfuric acid, and of maximum internal penetration, in the case of sodium hydroxide) was used. Alloys exhibiting corrosion rates of 0.45 mm/y or more are considered to be unacceptable. The basis for this criterion is related to iso-corrosion diagrams, which are used by industries to determine if alloys are acceptable or unacceptable at specified concentrations and temperatures in different chemicals. Several samples or test coupons of the alloy being considered are tested and the corrosion rate for each test is plotted. Then a line is fitted to the data points. In these diagrams, corrosion rates between 0.45 and 0.55 mm/y will often result in a plot line of 0.5 mm/y to take into account random and systematic variations. For many applications the art considers a corrosion rate of less than 0.5 mm/y to be acceptable. However, because alloys which have corrosion rates between 0.45 and 0.55 mm/y could be considered to have a corrosion rate of 0.5 mm/y, we concluded that corrosion rates must be below 0.45 mm/y to be acceptable and set that performance requirement for alloys of this invention.

Table 2 reveals that alloys of the present invention corrode at low enough rates in 70% sulfuric acid to be useful industrially at 93° C. and exhibit internal penetration rates that correspond to significantly less than 0.5 mm/y in 50% sodium hydroxide at 121° C. Interestingly, unlike the nickel-chromium-molybdenum alloys with high molybdenum contents (C-4, C-22, C-276, and C-2000), none of the alloys of this invention exhibited a dealloying form of corrosion attack. The required copper range of 3.1 to 6.0 wt. % and the proviso that if chromium is below 30 wt. %, then copper must be at least 4.7 wt. % are based on the results for several alloys, in particular A, B, C, E, and N. The relationships between chromium and copper are likely due to their respective influences on protective films in 70% sulfuric acid. It is known, for example, that chromium induces chromium rich passive films on metallic surfaces in oxidizing acids, and that copper can provide protection in concentrated sulfuric acid by plating metallic surfaces. Alloys K and L, with higher copper contents could not be forged.

The chromium range is based on the results for Alloys A and O (with contents of 27 and 33 wt. %, respectively). The molybdenum range is based on the results for Alloys H and A (with contents of 4.9 and 7.8 wt. %, respectively), and the suggestion of U.S. Pat. No. 6,764,646, which indicates that molybdenum contents below 4.9 wt. % do not provide sufficient resistance to general corrosion of the nickel-chromium-molybdenum-copper alloys. This is important for neutralizing systems containing other chemicals.

Surprisingly, when iron, manganese, aluminum, silicon, and carbon were omitted (Alloy G), the alloy could not be forged. To determine further the influence of iron, Alloy P, with no deliberate iron addition, was melted. The fact that Alloy P was successfully hot forged and hot rolled indicates that it is the presence of manganese, aluminum, silicon, and carbon that is critical to the successful wrought processing of these alloys. In addition, the absence of iron in alloy P was not detrimental from a corrosion standpoint as the alloy indicated excellent performance in both corrosive media.

TABLE 2

Corrosion Test Results for Experimental and Commercial Alloys

| Alloy | Corrosion Rate in 70% $H_2SO_4$ at 93° C. in 96 h (mm/y) | Mode of Attack in 50% NaOH at 121° C. in 720 h | Maximum Internal Penetration in 50% NaOH at 121° C. in 720 h (microns) | Comments |
|---|---|---|---|---|
| A* | 0.44 | GC | 10 [equiv. to 0.12 mm/y] | |
| B* | 0.32 | GC | 15 [equiv. to 0.18 mm/y] | |
| C | 0.48 | GC | 15 [equiv. to 0.18 mm/y] | |
| D | 0.64 | GC | 10 [equiv. to 0.12 mm/y] | |
| E* | 0.35 | GC | 11 [equiv. to 0.13 mm/y] | |
| F* | 0.30 | GC | 12 [equiv. to 0.15 mm/y] | |
| G | — | — | — | Unable to Process |
| H* | 0.34 | GC | 20 [equiv. to 0.24 mm/y] | |
| I* | 0.42 | GC | 8 [equiv. to 0.10 mm/y] | |
| J | 1.09 | GC | 10 [equiv. to 0.12 mm/y] | |
| K | — | — | — | Unable to Process |
| L | — | — | — | Unable to Process |
| M | 0.53 | GC | 17 [equiv. to 0.21 mm/y] | |
| N* | 0.42 | GC | 15 [equiv. to 0.18 mm/y] | |
| O* | 0.40 | GC | 8 [equiv. to 0.10 mm/y] | |
| P* | 0.40 | GC | 13 [equiv. to 0.16 mm/y] | |
| Q* | 0.39 | GC | 10 [equiv. to 0.12 mm/y] | |
| R* | 0.41 | GC | 10 [equiv. to 0.12 mm/y] | |
| S* | 0.30 | GC | 11 [equiv. to 0.13 mm/y] | |
| 200 | 2.60 | GC | 13 [equiv. to 0.16 mm/y] | |
| 400 | 2.03 | GC | 14 [equiv. to 0.17 mm/y] | |
| 600 | 7.20 | GC | 13 [equiv. to 0.16 mm/y] | |
| C-4 | 0.94 | Dealloying | 69 [equiv. to 0.84 mm/y] | |
| C-22 | 0.94 | Dealloying | 64 [equiv. to 0.78 mm/y] | |
| C-276 | 0.50 | Dealloying | 58 [equiv. to 0.71 mm/y] | |
| C-2000 | 0.37 | Dealloying | 38 [equiv. to 0.46 mm/y] | |
| G-30 | 0.98 | GC | 8 [equiv. to 0.10 mm/y] | |
| G-35 | 9.13 | GC | 8 [equiv. to 0.10 mm/y] | |

*denotes an alloy of this invention
GC—General Corrosion

The observations regarding the effects of the alloying elements are as follows: Chromium (Cr) is a primary alloying element, known to improve the performance of nickel alloys in oxidizing acids. When combined with molybdenum and copper (where special relationships apply), it has been shown to provide the desired corrosion resistance to both 70% sulfuric acid and 50% sodium hydroxide in the range 27 to 33 wt. %.

Molybdenum (Mo) is also a primary alloying element, known to enhance the corrosion-resistance of nickel alloys in reducing acids. In the range 4.9 to 7.8 wt. %, it contributes to the exceptional performance of the alloys of this invention in 70% sulfuric acid and 50% sodium hydroxide.

Copper (Cu), between 3.1 wt. %, and 6.0 wt. %, and in combination with the abovementioned levels of chromium and molybdenum, produces alloys with unusual and unexpected resistance to acids and alkalis, in the form of 70% sulfuric acid at 93° C. and 50% sodium hydroxide at 121° C.

Iron (Fe) is a common impurity in nickel alloys. Iron contents of up to 3.0 wt. % have been found to be acceptable in the alloys of this invention.

Manganese (Mn) is used to minimize sulfur in such alloys, and contents between 0.3 and 1.0 wt. % were found to result in successful alloys (from processing and performance standpoints).

Aluminum (Al) is used to minimize oxygen in such alloys, and contents between 0.1 and 0.5 wt. % were found to result in successful alloys.

Silicon (Si) is not normally required in corrosion-resistant nickel alloys, but is introduced during argon-oxygen decarburization (for those alloys melted in air). A small quantity of silicon (in the range 0.1 to 0.8 wt. %) was found to be essential in the alloys of this invention, to ensure forgeability.

Likewise, carbon (C) is not normally required in corrosion-resistant nickel alloys, but is introduced during carbon arc melting (for those alloys melted in air). A small quantity of carbon (in the range 0.01 to 0.11 wt. %) was found to be essential in the alloys of this invention, to ensure forgeability.

Traces of magnesium (Mg) and/or rare earth elements are often included in such alloys for control of unwanted elements, for example sulfur and oxygen. Thus, the usual range of up to 0.05 wt. % is preferred for each of these elements in the alloys of this invention.

Nitrogen (N) is easily absorbed by high chromium nickel alloys in the molten state, and it is usual to allow a maximum of 0.13 wt. % of this element in alloys of this kind.

Other impurities that might occur in such alloys, due to contamination from previously-used furnace linings or within the raw charge materials, include cobalt, tungsten, sulfur, phosphorus, oxygen, and calcium.

If enhanced microstructural stability at elevated temperatures (such as might be experienced during welding or during elevated temperature service) is desired, deliberate, small additions of elements which encourage the formation of MC carbides can be used. Such elements include titanium, niobium (columbium), hafnium, and tantalum. There are other less desireable MC carbides formers such as vanadium that could be used. MC carbides are much more stable than the $M_7C_3$, $M_6C$, and $M_{23}C_6$ carbides normally encountered in chromium- and molybdenum-containing nickel alloys. Indeed, it should be possible to control the levels of these MC-forming elements so as to tie up as much carbon as is deemed suitable to control the level of carbide precipitation in the grain boundaries. In fact, the MC-former level could be fine-tuned during the melting process, depending upon the real-time measurement of carbon content.

If the alloy is to be used to resist aqueous corrosion, the MC-former level could be matched to the carbon level to avoid appreciable grain boundary carbide precipitation (a so-called "stabilized" structure).

There are, however, two potential problems. First, nitrogen is likely to compete with carbon, resulting in nitrides or carbonitrides of the same active former (e.g. titanium), which should therefore be present at a higher level (this can be calculated based on the real-time measurement of the nitrogen content). Second is the unintended formation of gamma-prime (with titanium) or gamma-double prime (with niobium) phases; however, it should be possible to adjust the cooling and subsequent processing sequences to ensure that these elements are tied up in the form of carbides, nitrides, or carbonitrides.

Ignoring the nitrogen effect and using titanium as an example, to tie up all the carbon in the form of MC carbides would require atomic parity. Since the atomic weight of titanium is approximately four times that of carbon (47.9 versus 12.0), this would be reflected in the weight percentages of the two elements. Thus, stabilized versions of these alloys for aqueous corrosion service might contain 0.05 wt. % carbon and 0.20 wt. % titanium. Those for elevated temperature service might contain 0.05 wt. % carbon and 0.15 wt. % titanium, to allow a controlled level of secondary, grain boundary precipitation to enhance creep resistance. With nitrogen at an impurity level of 0.035 wt. %, for example, an additional 0.12 wt. % titanium would be necessary to tie up this element (since the atomic weight of nitrogen is 14.0). Thus, with a carbon content of 0.05 wt. %, 0.32 wt. % titanium might be required for aqueous corrosion service, and 0.27 wt. % titanium might be required for elevated temperature service. Accordingly, with a carbon level of 0.11 wt. %, and a nitrogen impurity level of 0.035 wt. %, 0.56 wt. % titanium might be required for aqueous corrosion service.

The atomic weights of niobium, hafnium, and tantalum are 92.9, 178.5, and 181.0, respectively. Thus, the niobium contents required to reap the same benefits are approximately double those for titanium. The hafnium or tantalum contents required to reap the same benefits are approximately quadruple those for titanium.

Accordingly, niobium stabilized versions of these alloys for aqueous corrosion service might contain 0.05 wt. % carbon and 0.40 wt. % niobium (if the alloy does not contain any nitrogen), and 0.64 wt. % niobium, if the nitrogen impurity level is 0.035 wt. %. With a carbon level of 0.11 wt. %, and a nitrogen impurity level of 0.035 wt. %, 1.12 wt. % niobium might be required for aqueous corrosion service. Alloys for elevated temperature service, in the absence of nitrogen impurities, might contain 0.05 wt. % carbon and 0.30 wt. % niobium.

Likewise, hafnium stabilized versions of these alloys for aqueous corrosion service might contain 0.05 wt. % carbon and 0.80 wt. % hafnium (if the alloy does not contain any nitrogen), and 1.28 wt. % hafnium, if the nitrogen impurity level is 0.035 wt. %. With a carbon level of 0.11 wt. %, and a nitrogen impurity level of 0.035 wt. %, 2.24 wt. % hafnium might be required for aqueous corrosion service. Alloys for elevated temperature service, in the absence of nitrogen impurities, might contain 0.05 wt. % carbon and 0.60 wt. % hafnium.

Likewise, tantalum stabilized versions of these alloys for aqueous corrosion service might contain 0.05 wt. % carbon and 0.80 wt. % tantalum (if the alloy does not contain any nitrogen), and 1.28 wt. % tantalum, if the nitrogen impurity level is 0.035 wt. %. With a carbon level of 0.11 wt. %, and a nitrogen impurity level of 0.035 wt. %, 2.24 wt. % tantalum might be required for aqueous corrosion service. Alloys for elevated temperature service, in the absence of nitrogen impurities, might contain 0.05 wt. % carbon and 0.60 wt. % tantalum.

Prior art concerning other high-chromium nickel alloys (U.S. Pat. No. 6,740,291, Crook) indicates that impurity levels of cobalt and tungsten in alloys of this kind can be tolerated at levels up to 5 wt. % and 0.65 wt. %, respectively. The acceptable impurity levels for sulfur (up to 0.015 wt. %), phosphorus (up to 0.03 wt. %), oxygen (up to 0.05 wt. %), and calcium (up to 0.05 wt. %) are defined in U.S. Pat. No. 6,740,291. These impurity limits are deemed appropriate for the alloys of this invention.

Even though the samples tested were in the form of wrought sheets, the alloys should exhibit comparable properties in other wrought forms, such as plates, bars, tubes, and wires, and in cast and powder metallurgy forms. Also, the alloys of this invention are not limited to applications involving the neutralization of acids and alkalis. Indeed, they might have much broader applications in the chemical process industries and, given their high chromium and the presence of copper, should be useful in resisting metal dusting.

Given a desire to maximize the corrosion resistance of these alloys, while optimizing their microstructural stability (hence ease of wrought processing), it is anticipated that the ideal alloy would comprise 31 wt. % chromium, 5.6 wt. % molybdenum, 3.8 wt. % copper, 1.0 wt. % iron, 0.5 wt. % manganese, 0.3 wt. % aluminum, 0.4 wt. % silicon, and 0.03 to 0.07 wt. % carbon, with a balance of nickel, nitrogen, impurities, and traces of magnesium and the rare earth elements (if used for the control of sulfur and oxygen). In fact, two alloys, Q and R, with this preferred nominal composition have been successfully melted, hot forged and rolled into sheet. As seen from Table 2, both alloys Q and R exhibited excellent corrosion resistance in the selected corrosive media. Moreover, with this aim nominal composition, a production scale heat (13,608 kg.) of alloy S has been melted and rolled successfully, thereby confirming that the alloy has excellent formability. This alloy also has desirable corrosion properties in 70% sulfuric acid at 93° C. and 50% sodium hydroxide at 121° C. A corresponding range (typical of melt shop practice) would be 30 to 33 wt. % chromium, 5.0 to 6.2 wt. % molybdenum, 3.5 to 4.0 wt. % copper, up to 1.5 wt. % iron, 0.3 to 0.7 wt. % manganese, 0.1 to 0.4 wt. % aluminum, 0.1 to 0.6 wt. % silicon, and 0.02 to 0.10 wt. % carbon, with a balance of nickel, nitrogen, impurities, and traces of magnesium and the rare earths (if used for the control of sulfur and oxygen).

What is claimed is:

1. A nickel-chromium-molybdenum-copper alloy resistant to sulfuric acid, having a corrosion rate of less than 0.45 mm/y in 70% sulfuric acid at 93° C. and resistant to sodium hydroxide, having a maximum internal attack corresponding to corrosion rate of less than 0.45 mm/y in 50% sodium hydroxide at 121° C., consisting essentially of:

27 and 29.9 wt. % chromium
4.9 to 7.8 wt. % molybdenum
4.7 to 6.0 wt. % copper
up to 3.0 wt. % iron
0.3 to 1.0 wt. % manganese
0.1 to 0.5 wt. % aluminum
0.1 to 0.8 wt. % silicon
0.01 to 0.11 wt. % carbon
up to 0.13 wt. % nitrogen
up to 0.05 wt. % magnesium
up to 0.05 wt. % rare earth elements
up to 0.56 wt. % titanium
up to 1.12 wt. % niobium
up to 2.24 wt. % tantalum
up to 2.24 wt. % hafnium
with a balance of nickel and impurities.

2. The nickel-chromium-molybdenum-copper alloy of claim 1, wherein the alloys are in wrought forms selected from the group consisting of sheets, plates, bars, wires, tubes, pipes, and forgings.

3. The nickel-chromium-molybdenum-copper alloy of claim 1, wherein the alloy is in cast form.

4. The nickel-chromium-molybdenum-copper alloy of claim 1, wherein the alloy is in powder metallurgy form.

5. The nickel-chromium-molybdenum-copper alloy of claim 1, wherein the alloy contains at least one MC carbide former.

6. The nickel-chromium-molybdenum-copper alloy of claim 5, wherein the MC carbide former is selected from the group consisting of titanium, niobium, tantalum and hafnium.

7. The nickel-chromium-molybdenum-copper alloy of claim 6, the alloy consisting essentially of 0.20 to 0.56 wt. % titanium.

8. The nickel-chromium-molybdenum-copper alloy of claim 6, the alloy consisting essentially of 0.30 to 1.12 wt. % niobium.

9. The nickel-chromium-molybdenum-copper alloy of claim 1, the alloy consisting essentially of 0.60 to 2.24 wt. % tantalum.

10. The nickel-chromium-molybdenum-copper alloy of claim 1, the alloy consisting essentially of 0.60 to 2.24 wt. % hafnium.

11. The nickel-chromium-molybdenum-copper alloy of claim 1, wherein the impurities are selected from the group consisting of cobalt, tungsten, sulfur, phosphorous, oxygen and calcium.

* * * * *